US005894618A

United States Patent [19]

Jacobsen et al.

[11] Patent Number: 5,894,618

[45] Date of Patent: Apr. 20, 1999

[54] RAMP SYSTEM

[75] Inventors: Gale L. Jacobsen, Northfield; Jeffrey J. Timmerman, North Maple Grove, both of Minn.

[73] Assignee: Emerald Group, Incorporated, Minneapolis, Minn.

[21] Appl. No.: 08/797,768

[22] Filed: Feb. 7, 1997

[51] Int. Cl.[6] ..... E02C 3/00

[52] U.S. Cl. ..... 14/69.5; 254/88; D34/32

[58] Field of Search ..... 14/69.5, 71.1, 14/2.4; 254/88; D34/32; 446/429

[56] References Cited

U.S. PATENT DOCUMENTS

| | | | |
|---|---|---|---|
| 1,624,243 | 4/1927 | Hoff et al. . | |
| 2,076,069 | 4/1937 | Davis . | |
| 4,013,268 | 3/1977 | Williams . | |
| 4,129,916 | 12/1978 | Schlesinger et al. . | |
| 4,285,514 | 8/1981 | Romero . | |
| 4,817,224 | 4/1989 | Visnaw et al. | 14/69.5 |
| 4,819,910 | 4/1989 | Johnston | 254/88 |
| 4,836,501 | 6/1989 | Baer | 254/88 |
| 5,446,937 | 9/1995 | Haskins | 14/69.5 |
| 5,483,715 | 1/1996 | Fogarty et al. | 14/69.5 |

*Primary Examiner*—James A. Lisehora
*Attorney, Agent, or Firm*—Schwegman, Lundberg, Woessner, and Kluth, P.A.

[57] ABSTRACT

The present invention relates to a ramp system. The ramp system includes a riser component that includes a first side and a second side that meets the first side. The second side and first side form an angle that is less than 90°. The ramp system also includes an adjuster component positionable within the riser component. The adjuster component lifts one end of the first side so that an angle that the second side makes with the horizontal is increased when compared to an angle made between the second side and the horizontal without the adjuster component.

11 Claims, 9 Drawing Sheets

RAMP SYSTEM

BACKGROUND OF INVENTION

The present invention relates to a system for elevating ramps and other structures and to a method for making a ramp system.

With the advent of sporting activities, such as skateboarding and in-line skating, accessories to these sports, such as ramps, have become increasingly desirable and popular. Because of the nature of these sporting activities, it is most desirable that ramps be lightweight, portable, sturdy, properly weighted and capable of accommodating several heights. Incorporating each of these features in a single ramp device has posed a formidable challenge to sport equipment manufacturers.

The Romeo patent, U.S. Pat. No. 4,285,514, issuing Aug. 25, 1981, describes a ramp with rectangular plates placed in juxtaposition to one another. The rectangular plates are interconnected by an elongated hinge capable of forming triangularly inclining surfaces. The ramp also has an apertured stick that is adjustably attachable to projections on the plates to vary the angles of the inclining surfaces for placement on the ground.

The Slessinger patent, U.S. Pat. No. 4,129,916, issuing Dec. 19, 1978, describes a ramp for use with skateboards. The ramp includes an elongated ramp section having its lower extremity juxtaposed to a supporting surface and an upper extremity disposed above and in spacial relationship with the supporting surface. A suspensory frame for the elongated ramp section and an adjustment system on the frame was present on the ramp for adjusting component portions of the frame with respect to each other.

Movable connections between the upper and lower extremities of the ramp member and frame can be manipulated to raise or lower the ramp member with respect to the supporting surface when the components of the ramp are adjusted to raise or lower the ramp member.

SUMMARY OF THE INVENTION

The present invention relates to a ramp system. The ramp system includes a riser component that includes a first side and a second side that meets the first side. The second side and first side form an angle that is less than 90°. The ramp system also includes an adjuster component that is received by the riser component. The adjuster component lifts one end of the first side of the riser so that an angle that the second side of the riser makes with the horizontal is increased when compared to an angle made between the second side of the riser and the horizontal without the adjuster component. The adjuster component is capable of adjusting the riser to two or more elevations.

DETAILED DESCRIPTION OF PREFERRED EMBODIMENTS

Figure 1B:
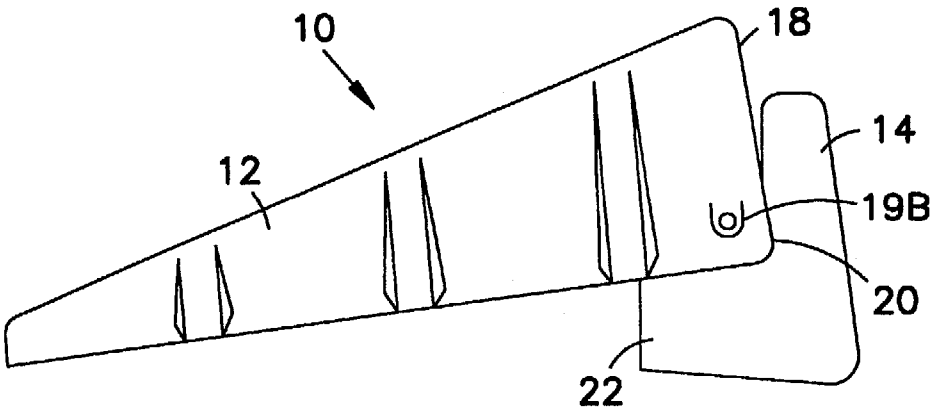
FIG. 1B illustrates the riser component of FIG. 1A in side view attached to the adjuster component of FIG. 1A wherein the adjuster component is in a second position.
Figure 1A:
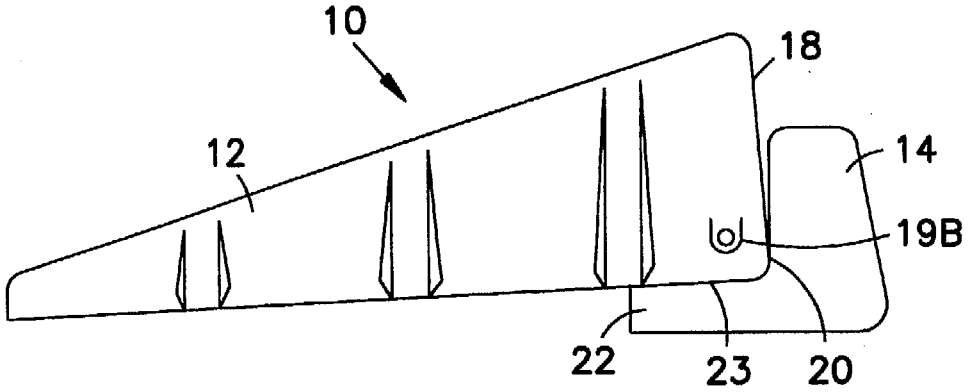
FIG. 1A illustrates a riser component of the ramp system of the present invention in side view, the riser component attached to an adjuster component in a first position.
Figure 3:
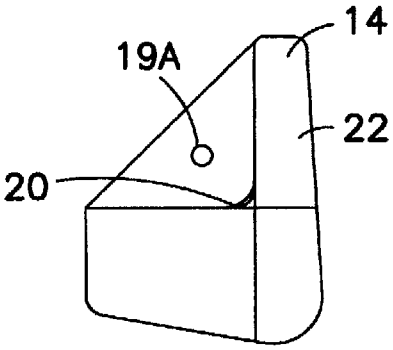
FIG. 3 illustrates one embodiment of the adjuster component of FIGS. 1A and 1B in side view.

The ramp system of the present invention illustrated, in one embodiment generally at 10 in FIGS. 1A and 1B includes a riser component 12 and an adjuster component 14 attached to the riser component 12. The adjuster component 14 is of a symmetry and includes a pair of orifices, illustrated at 19A and 19B in FIG. 6 and keys 84 and 85, shown in FIG. 6, that permit an interlock with the riser component 12 at a corresponding hole 19A or 19B, in at least two positions as are shown in FIGS. 1A and 1B. In the position shown in FIG. 1A, a vertical edge 18 of the riser component 12 is abutted against a corresponding edge 20 of the adjuster component 14. A horizontal edge 23 of the riser 12 then rests upon the adjuster component 14.

In a second position illustrated in FIG. 1B, the adjuster component 14 is rotated so that a first segment 22, that rests upon the horizontal edge 23, shown in FIG. 1A, is moved into a vertical position in FIG. 1B. The edge 18 of the riser component 12 abuts comer edge 20 of the adjuster component 14. As can be seen, in this second position, the riser 12 is at a steeper incline with respect to the horizontal than in position 1A. This second elevated position is made possible by a single simple radial movement of 180 degrees of the adjuster component 14 on the part of a user of the ramp system 10.

Unlike previous devices available, the system 10 of the present invention does not require complex, unreliable component interaction such as multiple hinges, for a successful change in elevation. The adjuster component 14 has been designed to fit in the riser component 12 in two positions with a single, simple movement on the part of a user. In one embodiment, illustrated at 100 in FIGS. 7 to 9 and FIG. 12, the adjuster component 116 fits within the riser component 120 at spaces 105 and 107 defined by the riser 120.

Because the ramp system of the present invention may be constructed from the two components, the system is very portable. The two components permit dimensions of the system to be compact. Further, the components may be made of polymers rendering the components to be lightweight.

Figure 4:
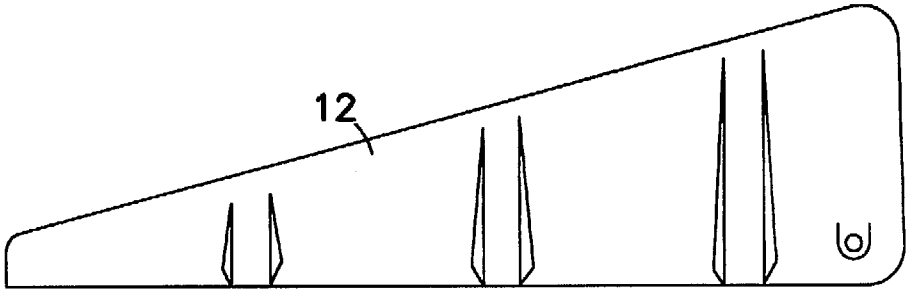
FIG. 4 illustrates one other embodiment of the riser component in side view.

In the embodiment shown in FIGS. 1A and 1B, the riser component 12 rests on the adjuster component 14. The adjuster component 14 is constrained with respect to the riser 12, in one embodiment by a pair of keys within a bore, one of which is shown at 19B in FIGS. 1A and 1B and keys which are shown at 84 and 85 in FIG. 6, insertable within corresponding aligned holes in the riser 12. The riser component 12, also illustrated in FIG. 4, has a length that may be about 22 inches.

Figure 6:
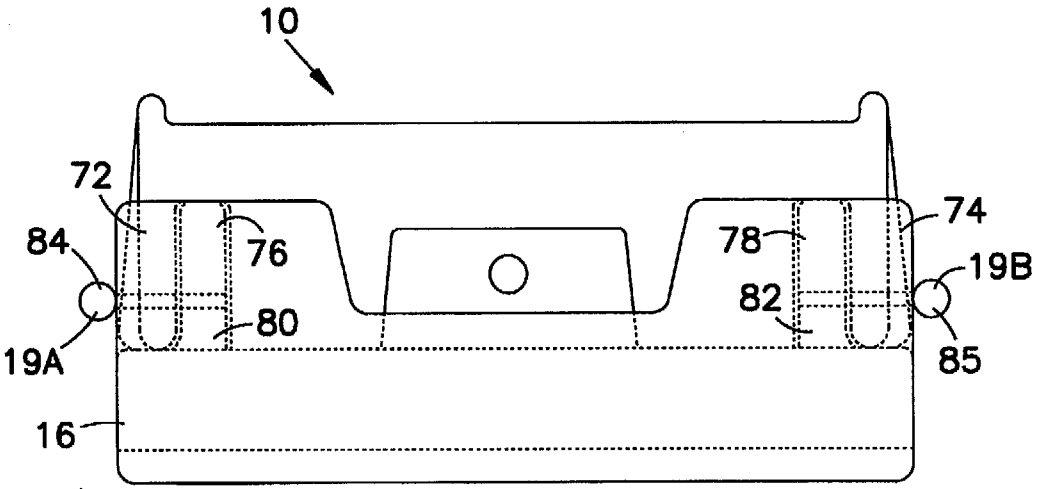
FIG. 6 illustrates an end view of the ramp system illustrated in FIGS. 1A and 1B.

A locking mechanism utilized in the ramp system embodiment 10, shown in FIG. 6, includes the bores 19A and 19B and keys 84 and 85 that pass through the bores. In one embodiment, the bores are defined by threaded walls and the keys each include a shaft insertable into the threads. In another embodiment, the keys are held under tension by a spring. Any other conventional locking mechanism may be used to attach the adjuster component 14 to the riser 12.

Figure 2:
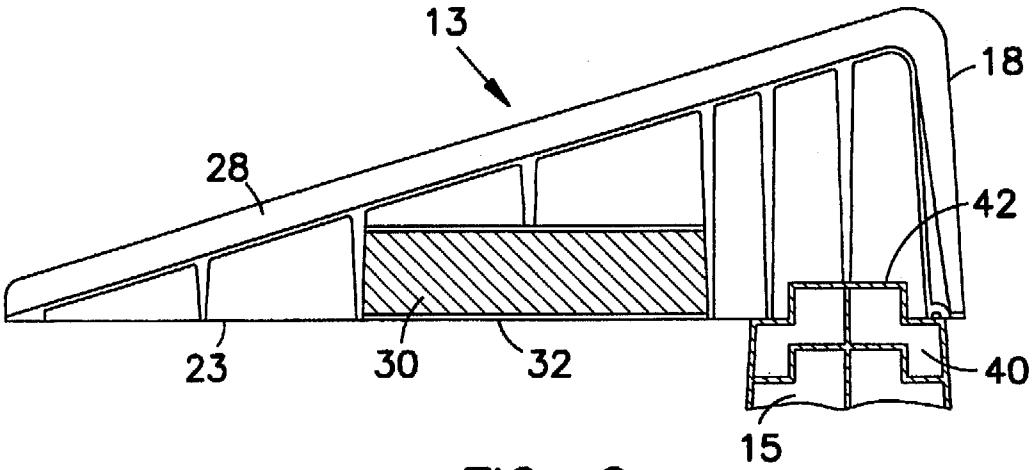
FIG. 2 illustrates a riser component embodiment in a side cross-sectional view with one other embodiment of the adjuster component.
Figure 15:
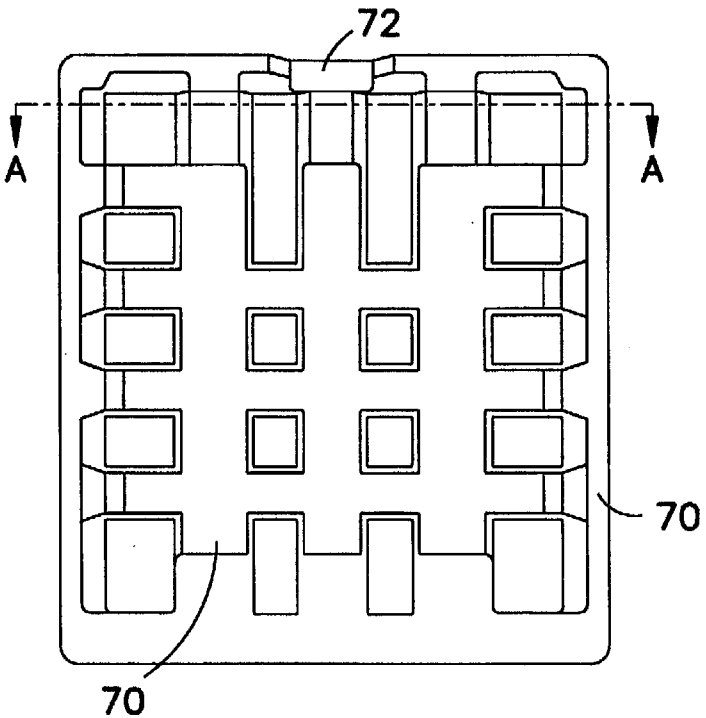
FIG. 15 illustrates a bottom view of one weighted embodiment of the riser component of the present invention.

In one ramp system embodiment illustrated at 28 in FIG. 2, the riser component 13 includes a weighted region 30. The weighted region 30 may be fabricated as a solid region that adds additional weight to the riser 13 at an area of the riser 13 that includes a center of gravity of the riser 13. The weighted region 30 may alternately be fabricated as a hollow region. The hollow region may be a single space or compartmentalized as shown at 70 in FIG. 15. A user may then fill this region with a material such as sand or water in order to add weight to the riser component 13. A fill orifice is shown in FIG. 15 at 72. With the riser component 13 embodiment shown in FIG. 2, a bottom wall 32 may be detached from the riser 13 in order to add the material and then reattached and secured in a conventional manner, such as with screws.

Figure 5:
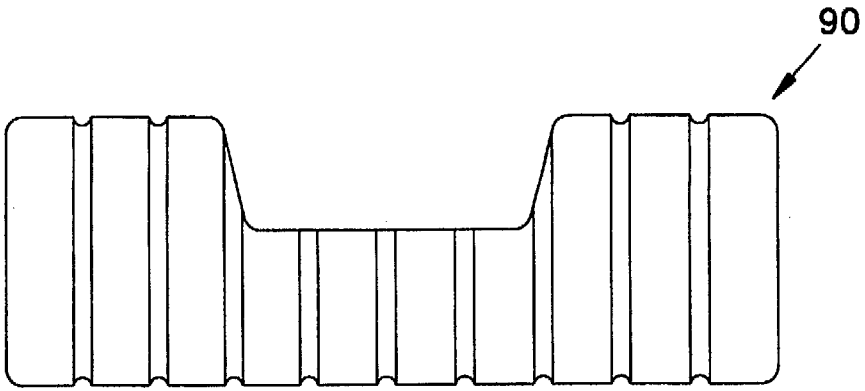
FIG. 5 illustrates a ribbed embodiment of the adjuster component of FIG. 6 in side view.

In one embodiment, the riser component embodiments 12 and 13 have a first section 23 with a length of about 7.2 inches and a second section 18 with a length of about 5.7 inches. The riser component embodiments generally may be made by polymer molding processes such as blow-molding, injection molding, compression molding or rotomolding. FIG. 5 illustrates a ribbed riser embodiment 90.

One other embodiment of the adjuster component is illustrated at 40 in FIG. 2. The adjuster component 40 is positioned so as to fit within a recess 42 within riser component 13. Unlike adjuster component 14, the adjuster component 40 has a single position that elevates the riser component 13 a single length with respect to the horizontal. The adjuster component 40 includes an orifice for receipt of an second adjuster component 40 to further elevate the riser 13, however.

Figure 12:
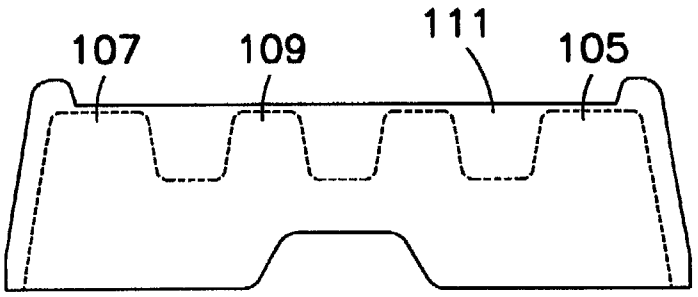
FIG. 12 illustrates a cross-sectional area taken along B—B in FIG. 7.
Figure 7:
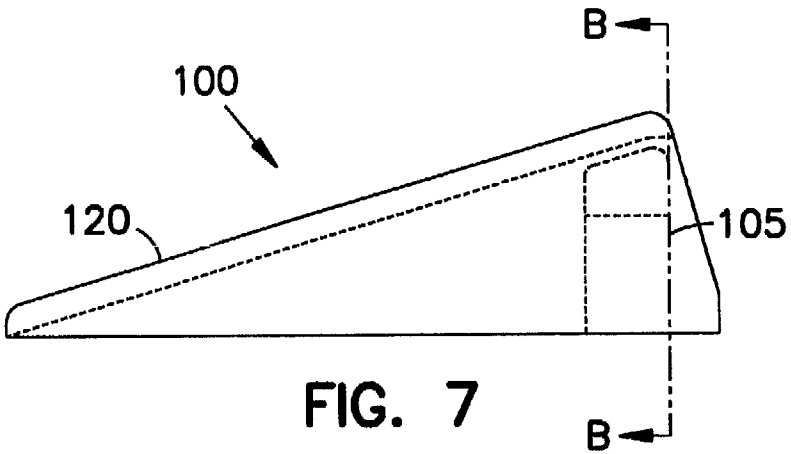
FIG. 7 illustrates a side view of another blow-molded embodiment of the riser component with a space for receiving an adjuster component of the ramp system of the present invention.
Figure 9:
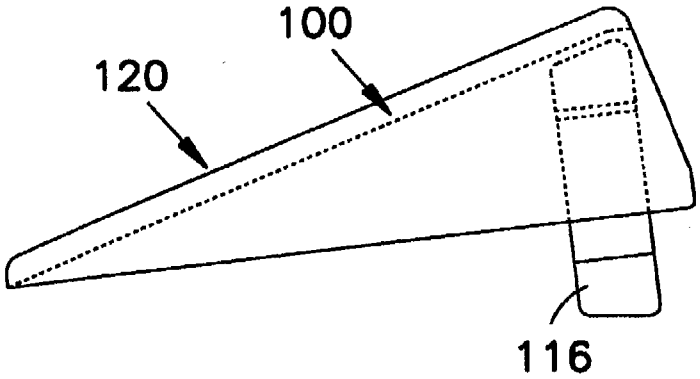
FIG. 9 illustrates a side view of the blow-molded embodiment of FIG. 7 with the adjuster component in a second position.
Figure 8:
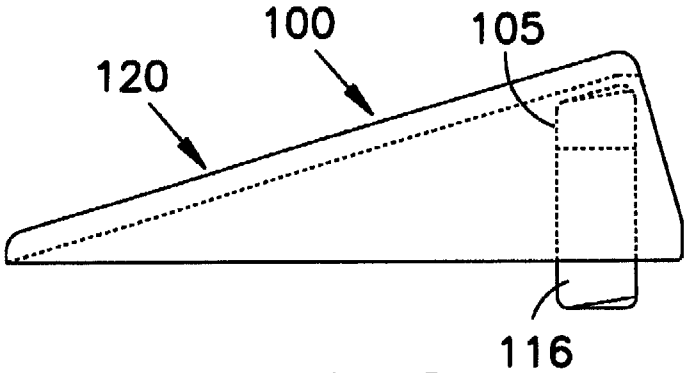
FIG. 8 illustrates a side view of the blow-molded embodiment of FIG. 7 with the adjuster component in a first position.
Figure 11:
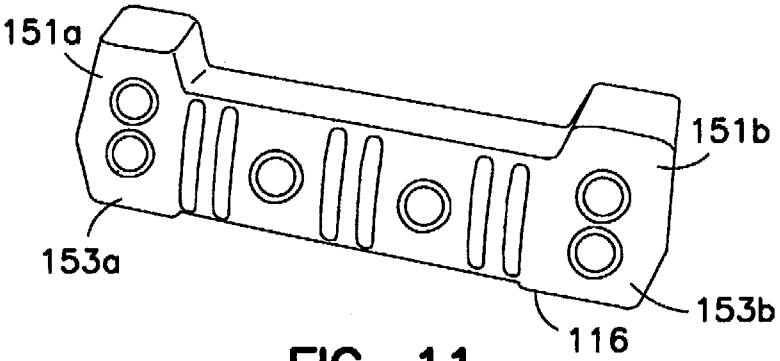
FIG. 11 illustrates a perspective view of the adjuster embodiment of FIG. 7, 8 and 9.

One blow-molded ramp system embodiment 100 is illustrated for several component positions in FIGS. 7, 8, and 9. FIG. 7 illustrates a riser component 120 that defines a space 105. The riser component 120 does not enclose an adjuster component as shown in FIG. 7. FIG. 12 illustrates the riser in cross-section taken along the line B—B in FIG. 7. This ramp system 100 position is the lowest position.

Figure 10:
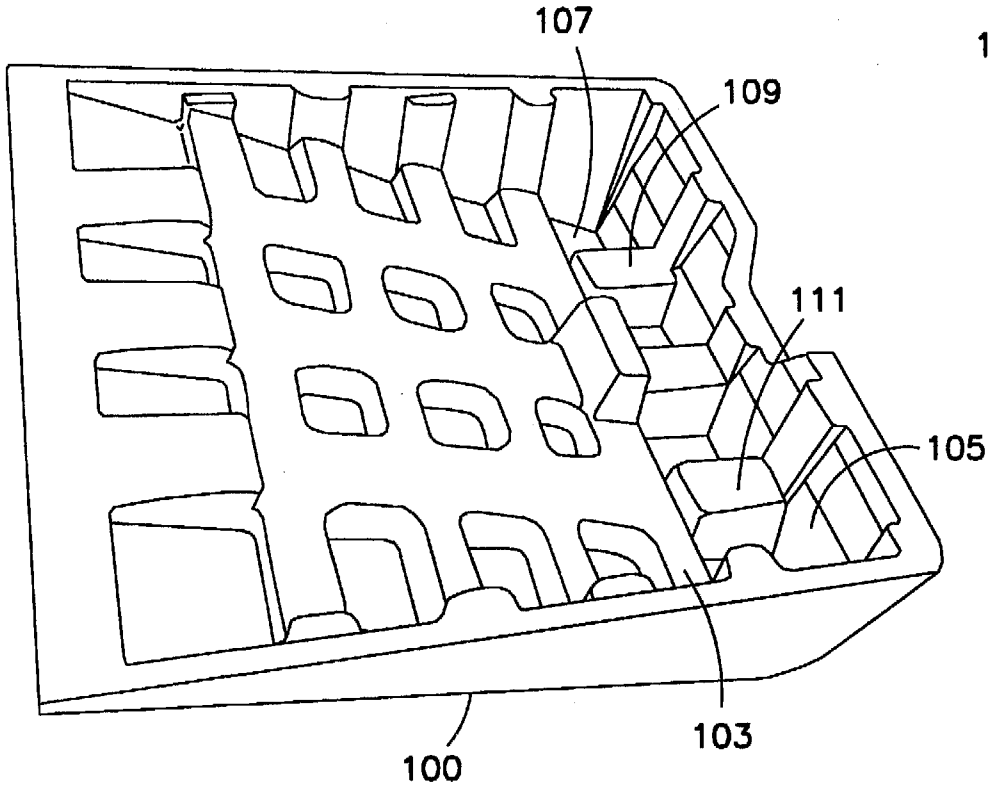
FIG. 10 illustrates a perspective, underside view of the riser embodiment of FIGS. 7, 8 and 9.

The riser 120 includes an underside, illustrated at 103 in FIG. 10, that defines spaces 105 and 107 that receive bearings **151*a* and 151*b* and 153*a* and *b* of the adjuster component 116. Bearings 109 and 111 support the adjuster 116 and limit motion of the adjuster 116**.

The blow-molded ramp system embodiment 100 is shown in an elevated position in FIGS. 8 and 9. The riser component 120 is elevated upon insertion of an adjuster component 116 into the spaces 105 and 107 shown in FIG. 10.

The blow-molded embodiment 100 is shown in a second elevated position in FIG. 9. The riser component 120 is further elevated by positioning of the adjuster 116 in a second position. The adjuster 116 has a greater length exposed under the riser 100 in FIG. 9 than in 7 or 8.

The adjuster component 116, contacts the riser 100 so that in a low riser position, bearings **151*a* and 151*b* are positioned in spaces 107 and 105. In a high riser position, bearings 153*a* and 153*b* are positioned in spaces 107 and 105. In the high riser position, riser bearings 109 and 111 restrict vertical and horizontal positioning of the bearings 153*a* and 153*b***.

Figure 18:
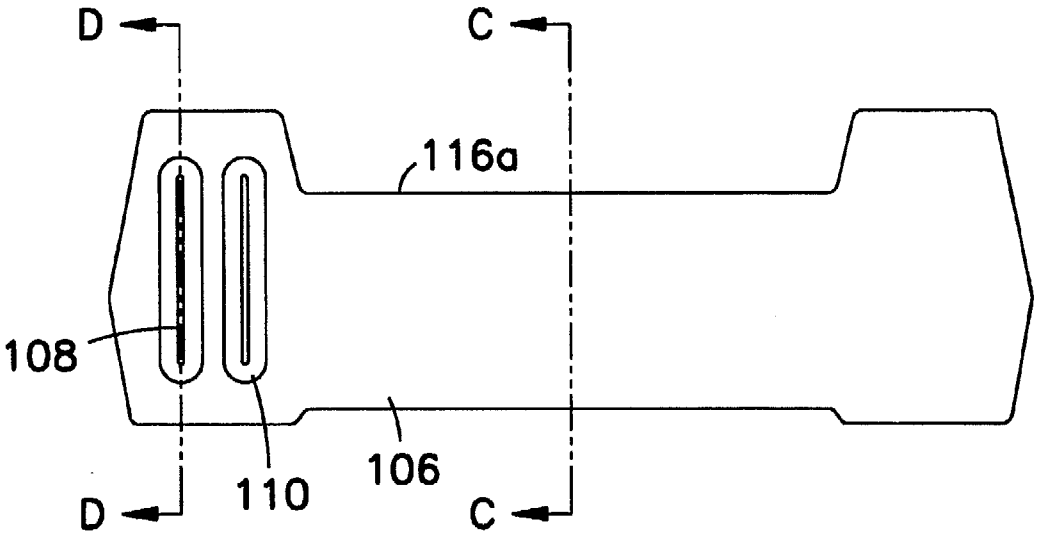
FIG. 18 is a side view of one further embodiment of the adjuster component of the present invention.
Figure 20:
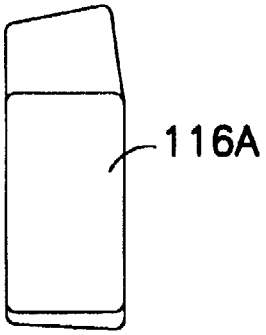
FIG. 20 is a cross-sectional view of the embodiment of the adjuster component illustrated in FIG. 18 taken along the line C—C.
Figure 19:
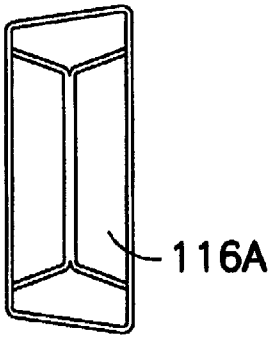
FIG. 19 is a cross-sectional view of another embodiment of the adjuster component of the present invention taken through line D—D of FIG. 18.

An adjuster component **116*a* shown in FIG. 18 includes fused regions 108 and 110. A side elevational view of an adjuster component embodiment 116*a* taken through line D—D in FIG. 18 is illustrated in FIG. 19. A second cross sectional area of adjuster component 116*a*, take along the line C—C in FIG. 18 is shown in FIG. 20**.

Figure 14:
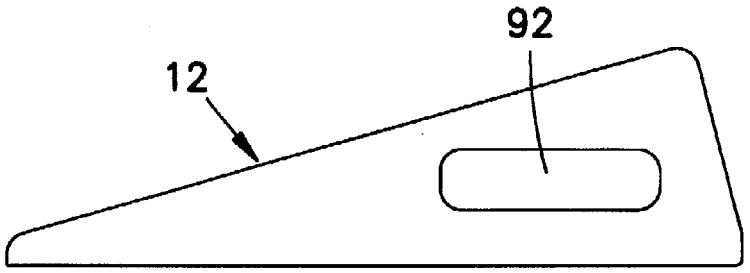
FIG. 14 illustrates a side view of a recessed embodiment of the riser component.
Figure 17:
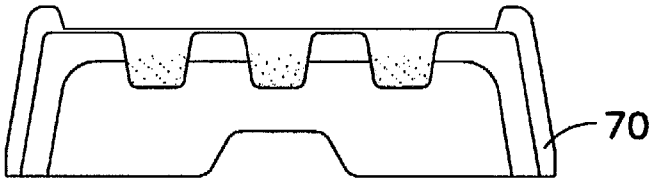
FIG. 17 illustrates a cross-sectional view of the riser component of FIG. 15 at line A—A.

The riser component 120 may optionally include a recess such as is shown at 92 in FIG. 14. The recess may receive a label or other type of design. The riser component 100 may also include decaling.

Figure 13:
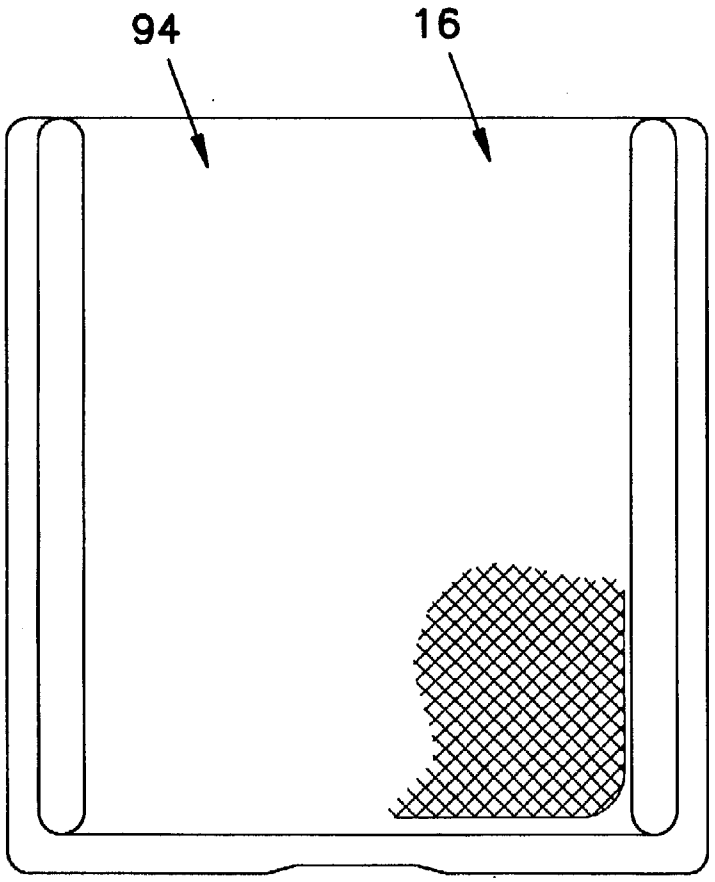
FIG. 13 illustrates a top elevational view of a riser component with an anti-skid surface.
Figure 16:
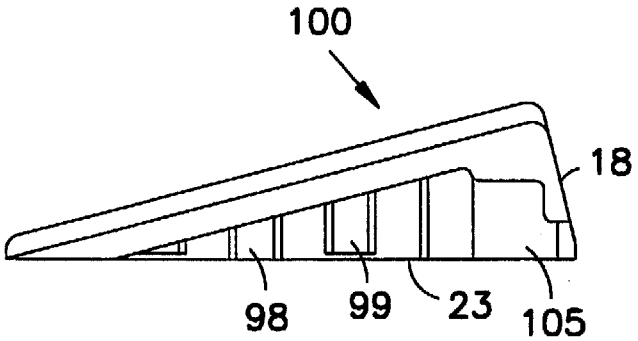
FIG. 16 illustrates a side cross-sectional view of one other blow-molded riser embodiment of the present invention.

In an embodiment shown in FIG. 13, a top surface 94 of the riser component 12 is engraved with anti-skid patterns. In FIG. 13, the engraved anti-skid pattern is in the shape of diamonds. It is also contemplated that other types of engraved patterns having an anti-skid function may be usable on the top surface 94. The anti-skid surface may be used with any riser embodiment The riser component 100 is shown in cross-section in FIG. 16. The blow-molded riser component 100 differs from other fabricated risers such as those fabricated by injection molding or other molding processes in that the blow-molded riser includes a number of compartments. Such compartments are shown, for instance, at 98 and 99 in FIG. 16. The riser component 100 further includes the space 105 defined by walls so as to receive an adjuster component such as is described in FIGS. 7 to 9.

In one embodiment of the ramp system 10 and 120, the adjuster component elevates the riser component to an elevation of about 7 ½ inches. In one embodiment of the high position, the adjuster component elevates the riser component to a height of about 9 inches.

The ramp systems described herein of the present invention may be injection molded, blow-molded, compression molded, or rotomolded. Ramp system embodiment 10, illustrated in FIGS. 1A, 1B, and FIG. 6, as well as the adjuster embodiment in FIG. 5 are most preferably made by rotomolding. Ramp system embodiment 100 is most preferably made by blow molding.

Typically, injection molding produces a product having multiple ribs and compartments in order to prevent warpage of the the product during cooling and to facilitate flow during molding. The average cycle time for fabricating each component by injection molding is in a range of 20 to 60 seconds. With injection molding, a mold must be fabricated for each component.

In extrusion blow molding, a uniform melt is prepared, forced through a forming die to a produce a hollow tube of molten plastic, called a parison, and blown into an exact product shape. In particular, a mold is positioned with the parison between two female mold halves. The mold closes over the parison, pinching one end and enclosing a compressed air entry pipe at the other end. The closed parison is then pressurized.

Extrusion is typically a continuous operation as compared with injection molding, which is typically intermittent, although extrusion may also be intermittent. Extrusion tooling is typically low cost.

In rotational molding, a product is formed from liquid or powered thermoplastic resin inside a closed mold while the mold is rotating biaxially in a heating chamber. Rotational molding or "rotomolding" offers an advantage of virtually unlimited design possibilities and relatively low machinery costs. Rotomolding also has low tooling costs and economical prototyping. Rotomolding allows simultaneous processing of multiple colors and simultaneous processing of different parts. Rotomolding also permits double walled parts molded for additional rigidity.

In compression molding, quantity production is possible through a use of multiple cavity molds. Compression molding avoids waste of material in a form of spru, runners and transfer culls. Internal stresses in a compression molded article are minimized by a shorter and multidirectional flow of polymeric material under pressure in a mold cavity.

Components of the ramp system of the present invention may be made from a variety of materials that include high density and low density polyethylene, polypropylene, polyurethane, and PVC. These materials permit the components to be strong, resiliant and light weight. The light weight feature further enhances the portable feature of the ramp system for all embodiments. The portable feature is additionally enhanced by dimensions of the ramp system. In one embodiment, dimensions are 24 inches by 24 inches by 6 inches in a low position.

Although preferred embodiments of the invention have been described in considerable detail, such description is intended to be illustrative rather than limiting, for the invention may be variously embodied and is to be limited only by interpretation of the claims which follow.

What is claimed is:

1. A ramp system comprising:

a riser component that includes a first side and a second side that meets the first side, the second side and first side forming an angle that is less than 90°; and an adjuster component that includes bearings having a first length and bearings having a second length reversibly contacting the riser component wherein the adjuster component in a first position lifts one end of the first side of the riser component so that an angle that the second side of the riser component makes with the horizontal is increased when compared to an angle made between the second side and the horizontal without the adjuster component and wherein in the first position the second side of the riser is at a steeper angle with respect to the horizontal than when the adjuster component is in a second position.

2. The ramp system of claim 1 wherein the adjuster component includes an opposing pair of nubs insertable within indentations within the riser component to form an axis.

3. The ramp system of claim 1 wherein the adjuster component is rotatable so that the bearings having a first length can be replaced with respect to a position with the bearings having a second length.

4. The ramp system of claim 1 wherein the riser component is weighted by an internal weight in a space that encompasses the center of gravity.

5. The ramp system of claim 1 wherein each of the riser component and adjuster components is made of polypropylene.

6. The ramp system of claim 1 wherein each of the adjuster component and riser components is made of high density polyethylene.

7. The ramp system of claim 1 wherein the riser component includes an upper surface having an anti-skid pattern.

8. The ramp system of claim 1 wherein the riser component encloses a space complimentary to the adjuster component symmetry.

9. The ramp system of claim 1 wherein the riser component rests upon the adjuster component.

10. The ramp system of claim 9 wherein the riser component is free of an orifice for receiving the adjuster component.

11. The ramp system of claim 1 wherein the adjuster component includes an orifice for receipt of a block.

* * * * *